US011835925B2

(12) United States Patent
Zaugg et al.

(10) Patent No.: US 11,835,925 B2
(45) Date of Patent: Dec. 5, 2023

(54) TIMEPIECE ROTATING REGULATOR MECHANISM

(71) Applicant: Montres Breguet S.A., L'Abbaye (CH)

(72) Inventors: Alain Zaugg, Le Sentier (CH); Christophe Riedo, Le Lieu (CH)

(73) Assignee: Montres Breguet S.A., L'Abbaye (CH)

( * ) Notice: Subject to any disclaimer, the term of this patent is extended or adjusted under 35 U.S.C. 154(b) by 178 days.

(21) Appl. No.: 17/318,053

(22) Filed: May 12, 2021

(65) Prior Publication Data

US 2021/0389726 A1 Dec. 16, 2021

(30) Foreign Application Priority Data

Jun. 16, 2020 (EP) ..... 20180298

(51) Int. Cl.
*G04B 18/04* (2006.01)
*G04B 17/32* (2006.01)
*G04B 18/02* (2006.01)

(52) U.S. Cl.
CPC ..... *G04B 18/04* (2013.01); *G04B 17/32* (2013.01); *G04B 18/028* (2013.01)

(58) Field of Classification Search
CPC ..... G04B 18/04; G04B 18/028
See application file for complete search history.

(56) References Cited

U.S. PATENT DOCUMENTS

2016/0223989 A1* 8/2016 Winkler ..... G04B 17/28
2016/0327909 A1* 11/2016 Henein ..... G04B 23/005
2017/0068216 A1* 3/2017 Winkler ..... G04B 17/26
2017/0153603 A1* 6/2017 Carreno ..... G04B 19/247
(Continued)

FOREIGN PATENT DOCUMENTS

CH 709 533 A2 10/2015
CN 202870463 U 4/2013
(Continued)

OTHER PUBLICATIONS

European Search Report dated Dec. 1, 2020 in European Application 20180298.0 filed Jun. 16, 2020 (with English Translation of Categories of Cited Documents), 3 pages.
(Continued)

*Primary Examiner* — Edwin A. Leon
*Assistant Examiner* — Matthew Hwang
(74) *Attorney, Agent, or Firm* — Oblon, McClelland, Maier & Neustadt, L.L.P.

(57) ABSTRACT

A timepiece rotating regulator mechanism for regulating the rotational speed of a mechanism subjected to the action of a motor device through a transmission device, including an oscillator mechanism indirectly connected to the transmission device by a movement transformation device including a connecting-rod-crank-handle system, with a crank-handle rotated about a crank-handle axis by the transmission device, and a connecting-rod angularly moveable on the one hand in relation to the crank-handle, and on the other hand in relation to an inertial mass that this oscillator mechanism includes, to ensure the maintenance of the oscillator mechanism by the energy supplied by the motor device, and to ensure the speed regulation of a train that the transmission device include in relation to the frequency of the oscillator mechanism.

14 Claims, 5 Drawing Sheets

(56) References Cited

U.S. PATENT DOCUMENTS

| | | | | |
|---|---|---|---|---|
| 2018/0107161 | A1* | 4/2018 | Winkler | G04B 15/02 |
| 2018/0120769 | A1 | 5/2018 | Helfer et al. | |
| 2021/0208537 | A1* | 7/2021 | Goujon | G04B 17/26 |

FOREIGN PATENT DOCUMENTS

| | | | |
|---|---|---|---|
| CN | 104062879 | A | 9/2014 |
| CN | 107976890 | A | 5/2018 |
| EP | 2 908 189 | A2 | 8/2015 |
| EP | 3 081 996 | A1 | 10/2016 |
| EP | 3 312 683 | A1 | 4/2018 |
| WO | WO 2019/106448 | A1 | 6/2019 |

OTHER PUBLICATIONS

Combined Chinese Office Action and Search Report dated Jul. 4, 2022 in Chinese Patent Appiication No. 202110660510.1 (with English transiation), 14 pages.

* cited by examiner

TIMEPIECE ROTATING REGULATOR MECHANISM

CROSS-REFERENCE TO RELATED APPLICATION

This application claims priority to European Patent Application No. 20180298.0 filed on Jun. 16, 2020, the entire disclosure of which is hereby incorporated herein by reference.

FIELD OF THE INVENTION

The invention relates to a timepiece rotating regulator mechanism for regulating the rotational speed of a timepiece mechanism subjected to the action of motor means through transmission means.

The invention also relates to a timepiece, in particular a watch, including at least one such rotating regulator mechanism.

The invention relates to the field of timepiece mechanism speed regulation.

BACKGROUND OF THE INVENTION

Microtechnologies have promoted the emergence of new types of rotating resonators, intended for the time bases of watches or of clocks, and generally driven by a slide-bar or a slide-way. Nevertheless, for the use of an oscillator in the timekeeper of a watch, a number of requirements must be met, which makes their use still very tricky:

- sensitivity to positions,
- sensitivity to manufacturing tolerances;
- reduced energy consumption;
- sensitivity to the phasing of two oscillations according to orthogonal axes;
- sensitivity to frictions of the drive slide-bar.

SUMMARY OF THE INVENTION

It can be seen that the use of slide-bar connections is not favourable for horological applications, whether this concerns time bases or ancillary functions related to the operation of complications.

The invention proposes to use a connecting-rod in replacement for the slide-bar proposed in the prior art. It also proposes to limit the use of such a regulation system to functions that are less demanding than the timekeeper of a watch, namely regulations of ancillary mechanisms such as striking mechanisms, date recesses or other movements having to be regulated in a watch without the frequency regulation requiring a precision in the order of a parts per million.

This means proposing a simple, entirely mechanical, mechanism.

To this end, the invention relates to a timepiece rotating regulator mechanism for regulating the rotational speed of a timepiece mechanism subjected to the action of motor means through transmission means, according to claim 1.

The invention also relates to a timepiece, in particular a watch, including at least one such rotating regulator mechanism.

SUMMARY DESCRIPTION OF THE DRAWINGS

Other features and advantages of the invention will become apparent upon reading the following detailed description, with reference to the appended drawings, where:

FIG. 1 shows, schematically, and partially in sectional view, a rotating regulator mechanism according to the invention, including a receiver wheel set guided in a bearing, and cooperating with a train transmitting thereto the energy of a barrel; this receiver wheel set is integral in rotation with a crank-handle, which is articulated with a connecting-rod, itself articulated with a protuberance of an inertial mass that an oscillator mechanism includes, which is other than that of the time base of the timepiece receiving this rotating regulator mechanism; this oscillator mechanism includes in this figure an elastic return means consisting of a single flexible blade;

DETAILED DESCRIPTION OF PREFERRED EMBODIMENTS

Figure 1:
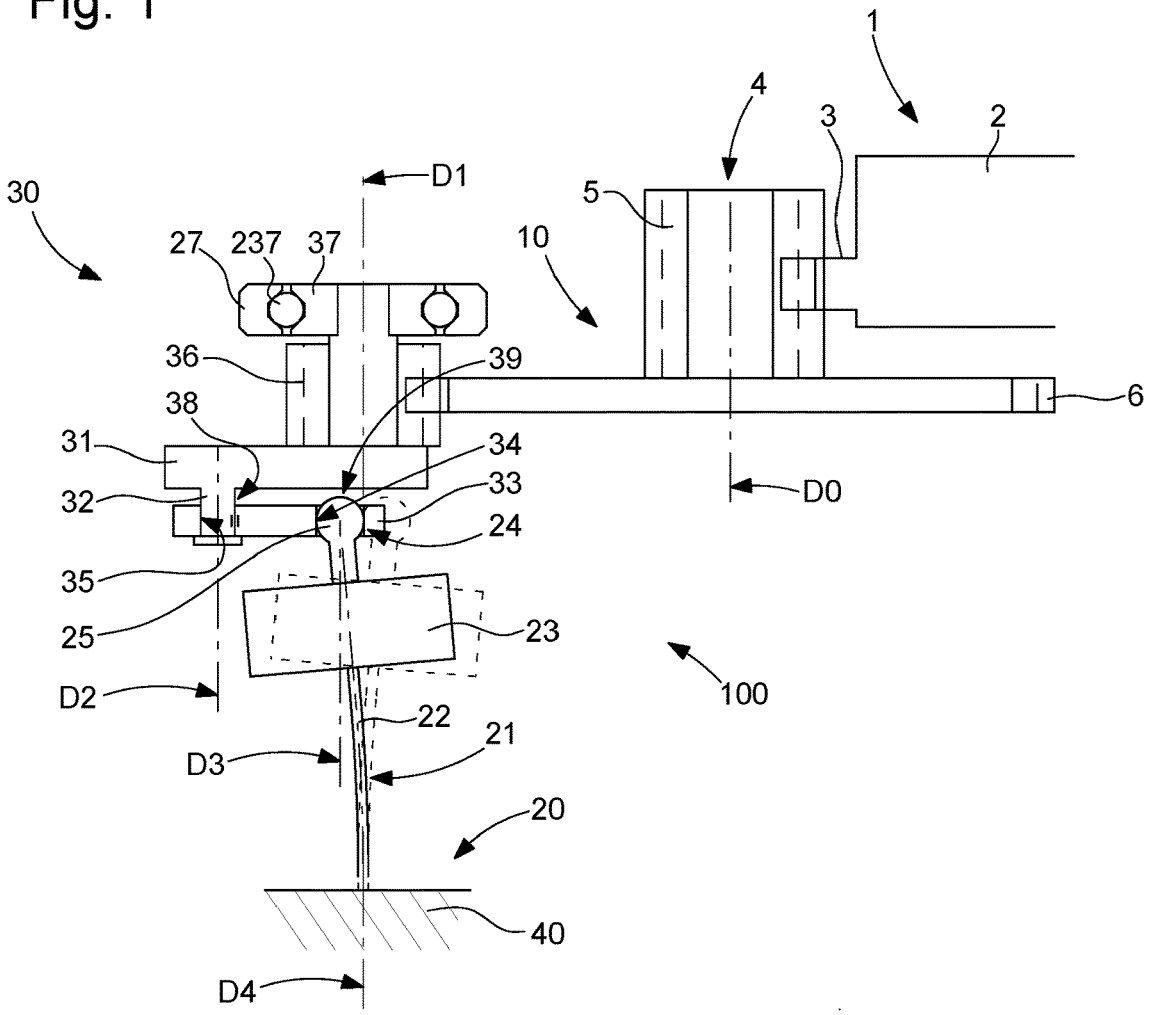
Figure 2:
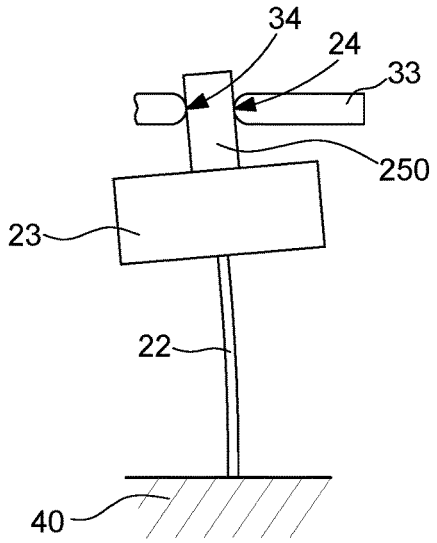
FIG. 2 shows, in a manner similar to FIG. 1, a detail of another variant of articulation between the inertial mass and the connecting-rod.

The invention relates to a timepiece rotating regulator mechanism 100 for regulating the rotational speed of a timepiece mechanism subjected to the action of motor means 1 through transmission means 10.

According to the invention, this rotating regulator mechanism 100 includes an oscillator mechanism 20, which is indirectly connected to the transmission means 10 by movement transformation means 30 including a connecting-rod-crank-handle system.

This oscillator mechanism 20 conventionally includes at least one inertial mass 23, which is subjected to the action of elastic return means 21.

The connecting-rod-crank-handle system includes at least one crank-handle 31, which is rotated about a crank-handle axis D1 by the transmission means 10.

The connecting-rod-crank-handle system also includes at least one connecting-rod 33, which is angularly moveable in relation to this crank-handle 31, in a plane perpendicular to the crank-handle axis D1, at a first contact zone 38 eccentric in relation to the crank-handle axis D1. This at least one connecting-rod 33 is angularly moveable in relation to an inertial mass 23 in a plane perpendicular to the crank-handle axis D1, at a second contact zone 39 that is distant from the first contact zone 38, to ensure the maintenance of the oscillator mechanism 20 by the energy supplied by the motor means 1, and to ensure the speed regulation of a train 4 that the transmission means 10 include in relation to the frequency of the oscillator mechanism 20.

More particularly, in an articulated variant visible in FIGS. 1 to 5, at least one connecting-rod 33 is articulated with the crank-handle 31 at a first articulation defining the first contact zone 38, and is also articulated with an inertial mass 23, at a second articulation defining the second contact zone 39.

More particularly, the connecting-rod-crank-handle system includes a receiver wheel set 36, which is integral with the crank-handle 31, and which is rotated about the crank-handle axis D1 by the transmission means 10. The crank-handle 31 includes, at the first articulation, a crank pin 32 or a bore, defining a crank pin axis D2 about which freely pivots, via a bore 35 or respectively a trunnion that it includes, the connecting-rod 33 that includes, at a distance from the crank pin axis D2, and at the second articulation, a guide 34 cooperating in a complementary manner with an additional guide 24 integral with an inertial mass 23.

Figure 6:
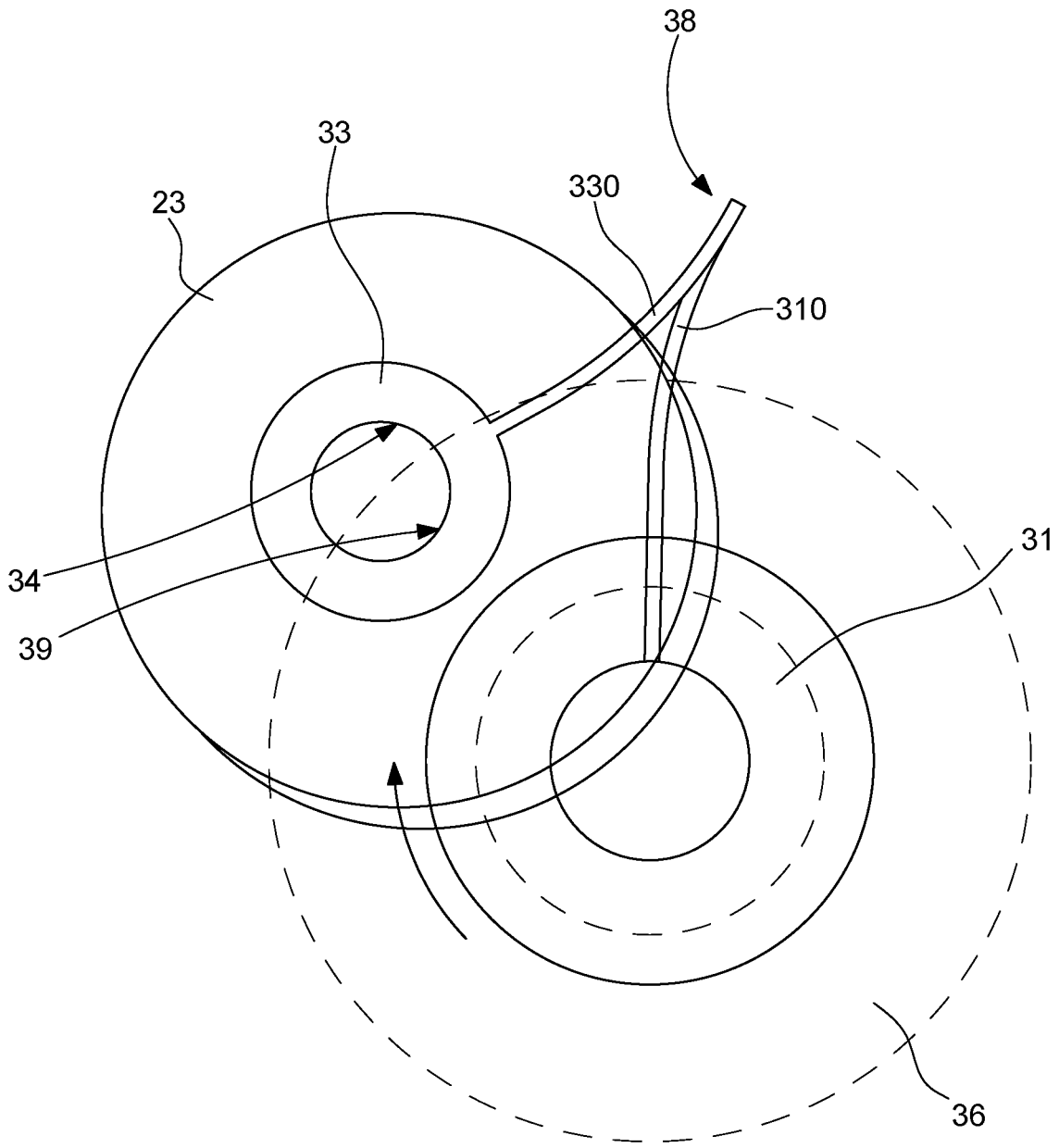
FIG. 6 shows, in a manner similar to FIG. 3, a detail of another variant wherein the articulation between connecting-rod and the crank-handle is replaced by a connection between flexible blades.

In one variant, and as can be seen in FIG. 6, at least one connecting-rod 33 is integral with at least one connecting-rod flexible blade 330 moveable in a plane perpendicular to the crank-handle axis D1, and angularly moveable, in this plane or in projection over this plane, in relation to at least one crank-handle flexible blade 310 that is integral with the at least one crank-handle 31 or constituting this crank-handle 31.

More particularly, at least one connecting-rod flexible blade 330 and at least one crank-handle flexible blade 310 are arranged on at least two parallel levels.

More particularly, at least one connecting-rod 33 and at least one crank-handle 31 together constitute a single one-piece component incorporating flexible blades. Such an arrangement makes it possible to further reduce the frictions, by eliminating a pivoting.

More particularly, the inertial mass 23 is arranged to oscillate about an oscillator axis D4 in relation to a fixed structure 40, to which the inertial mass 23 is fastened by at least one flexible blade 22 constituting the elastic return means 21 of the oscillator mechanism 20, and tending to return each inertial mass 23 towards the oscillator axis D4.

The distal end of the inertial mass 23 is arranged to move in a substantially flat manner, in an XY plane. The oscillator axis D4 is parallel with the crank-handle D1; more particularly, they are merged.

This oscillator mechanism 20 is more particularly built as an inertial mass 23 supported by a wire or a bending round bar. It is understood that the rotation of the inertial mass 23 may be broken down into an alternative sinusoidal bending of the wire along the X axis and an alternative sinusoidal bending along the Y axis, out of phase by 90°.

More particularly, this flexible blade 22 is unique.

More particularly, at least one flexible blade 22 consists of a bending and/or twisting wire.

In other variants not illustrated, the oscillator mechanism 20 includes a plurality of flexible blades or flexible wires, arranged or arranged in bundles, or parallel with one another, or others.

Figure 8:
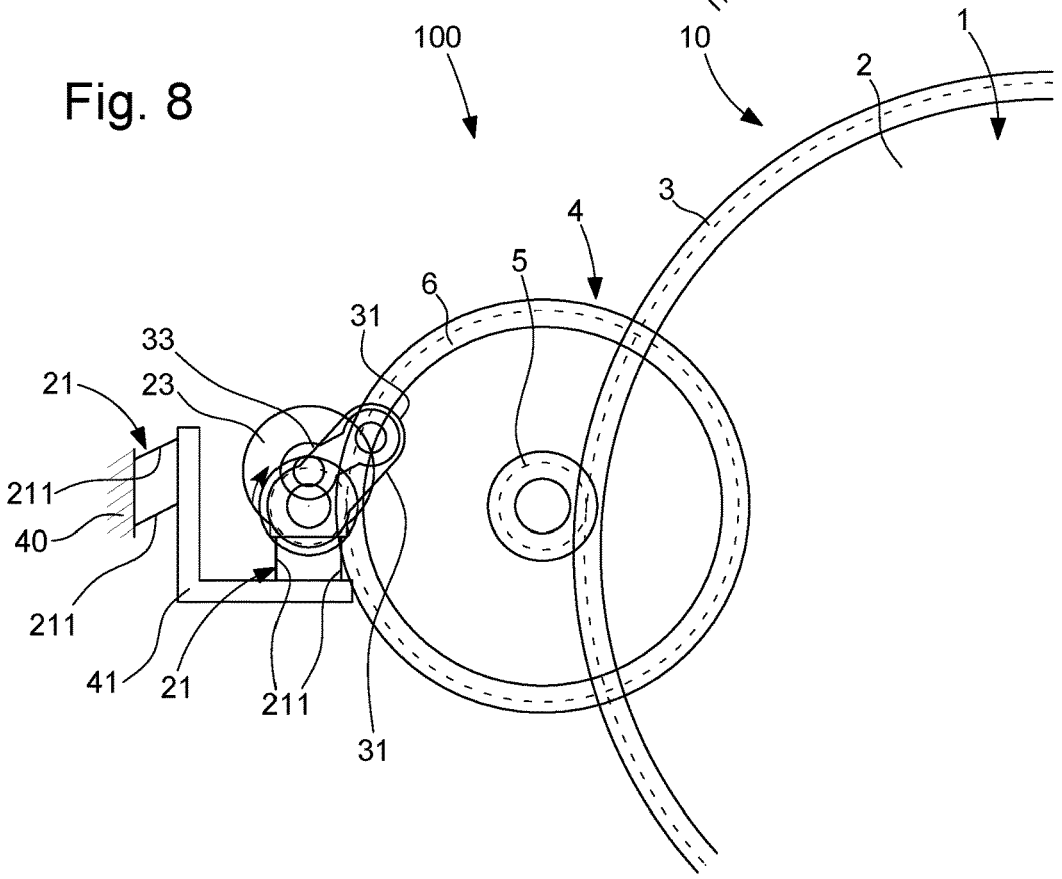
FIG. 8 shows, in a manner similar to FIG. 3, a detail of another variant that includes a rotating oscillator wherein the inertial mass is suspended by flexible blades.

In one variant, as can be seen in FIG. 8, the inertial mass 23 is arranged to oscillate about an oscillator axis D4 in relation to a fixed structure 40 to which the inertial mass 23 is suspended by at least one set of elastic blades 211 parallel with one another, by means of an intermediate support 41, this at least one set of elastic blades constituting the elastic return means 21 of the oscillator mechanism 20 and tending to return the at least one inertial mass 23 towards the oscillator axis D4.

Figure 7:
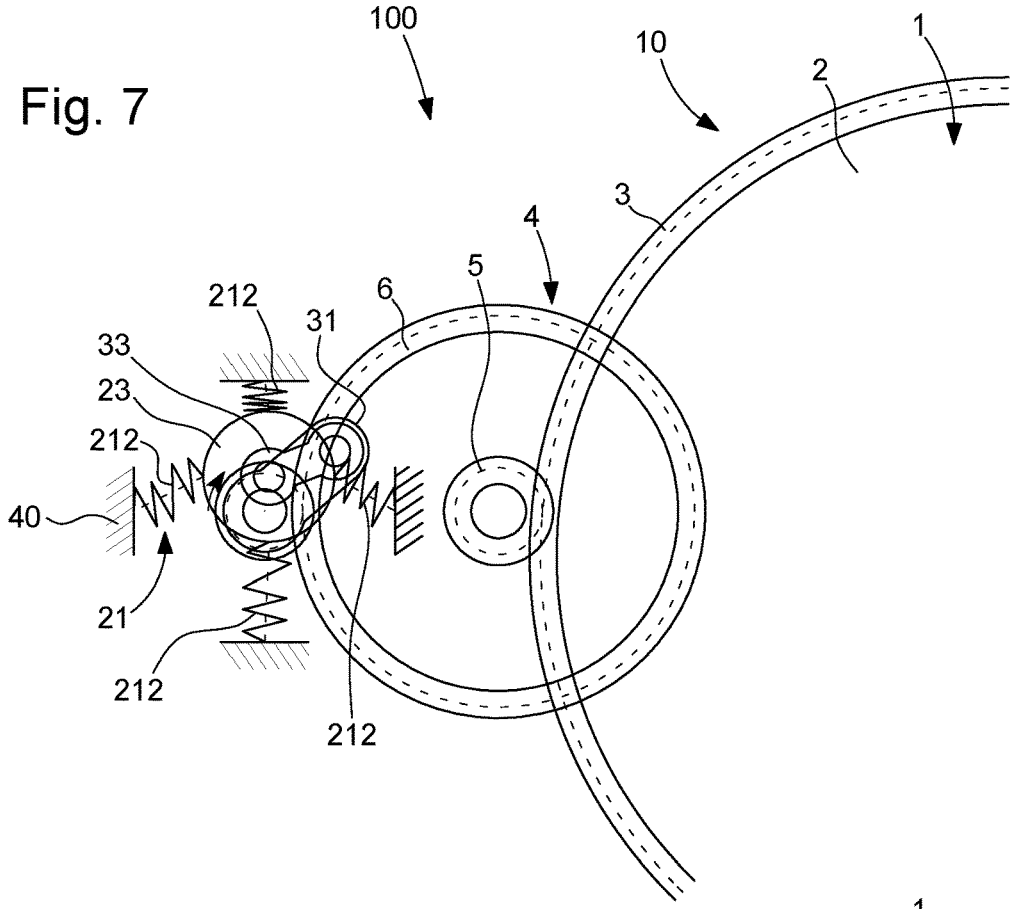
FIG. 7 shows, in a manner similar to FIG. 3, a detail of another variant, that includes a rotating oscillator wherein the inertial mass is suspended by springs.

In another variant, as can be seen in FIG. 7, the inertial mass 23 is arranged to oscillate about an oscillator axis D4 in relation to a fixed structure 40 to which the inertial mass 23 is suspended by springs 212 constituting the elastic return means 21 of the oscillator mechanism 20 and tending to return the at least one inertial mass 23 towards the oscillator axis D4.

More particularly, either the guide 34 is a bore and the additional guide 24 is a spherical surface of a ball joint 25 integral with an inertial mass 23, or the guide 34 is a toric surface and the additional guide 24 is a cylindrical surface of a trunnion 250 integral with an inertial mass 23.

The drive system must be arranged to avoid that a possible phase shift of the two axes (different by 90°) does not reduce the oscillation of one of the axes.

Figure 9:
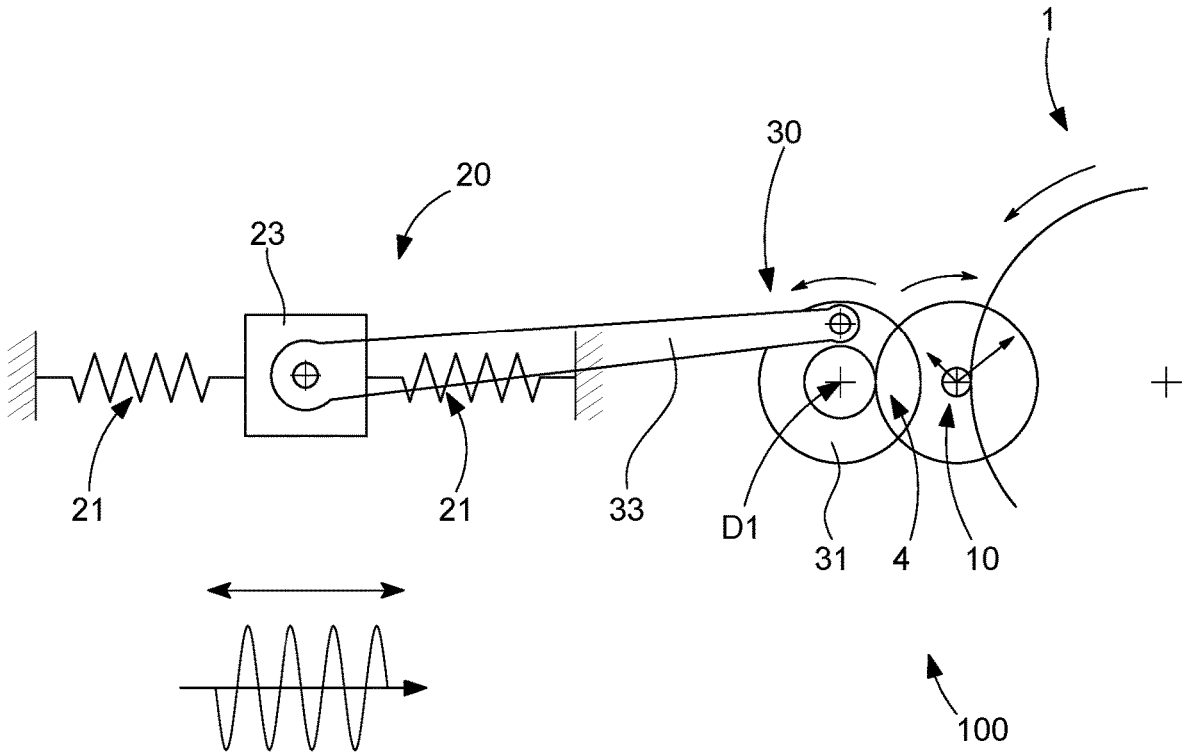
FIG. 9 shows, in a manner similar to FIG. 1, another variant wherein the inertial mass has a linear oscillation.
Figure 10:
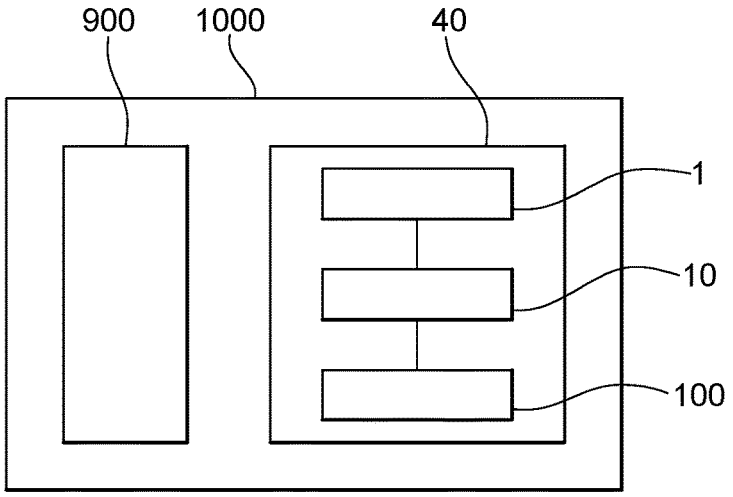
FIG. 10 is a block diagram showing a timepiece, in particular a watch, including a main oscillator constituting a time base, and an oscillator mechanism for another horological function, integrated into a rotating regulator mechanism according to the invention.

In yet another variant, and as can be seen in FIG. 9, the inertial mass 23 is arranged to oscillate linearly as in the figure, or according to a single degree of freedom along an imposed path, and is subjected on either side to the action of elastic return means 21 that are fastened to a fixed structure that the rotating regulator mechanism 100 includes.

In a slide-bar mechanism of the prior art, the movements of the drive axis, due to the amplitude differences related to the energy dissipated and to possible phase shifts of the two oscillations in X and Y, generate frictions that are detrimental to the function.

Thus, the invention replaces the slide-bar known from the prior art with a connecting-rod-crank-handle pair, which meets the freedom of radius condition up to a minimum and limits the frictions to two pivotings.

Figure 3:
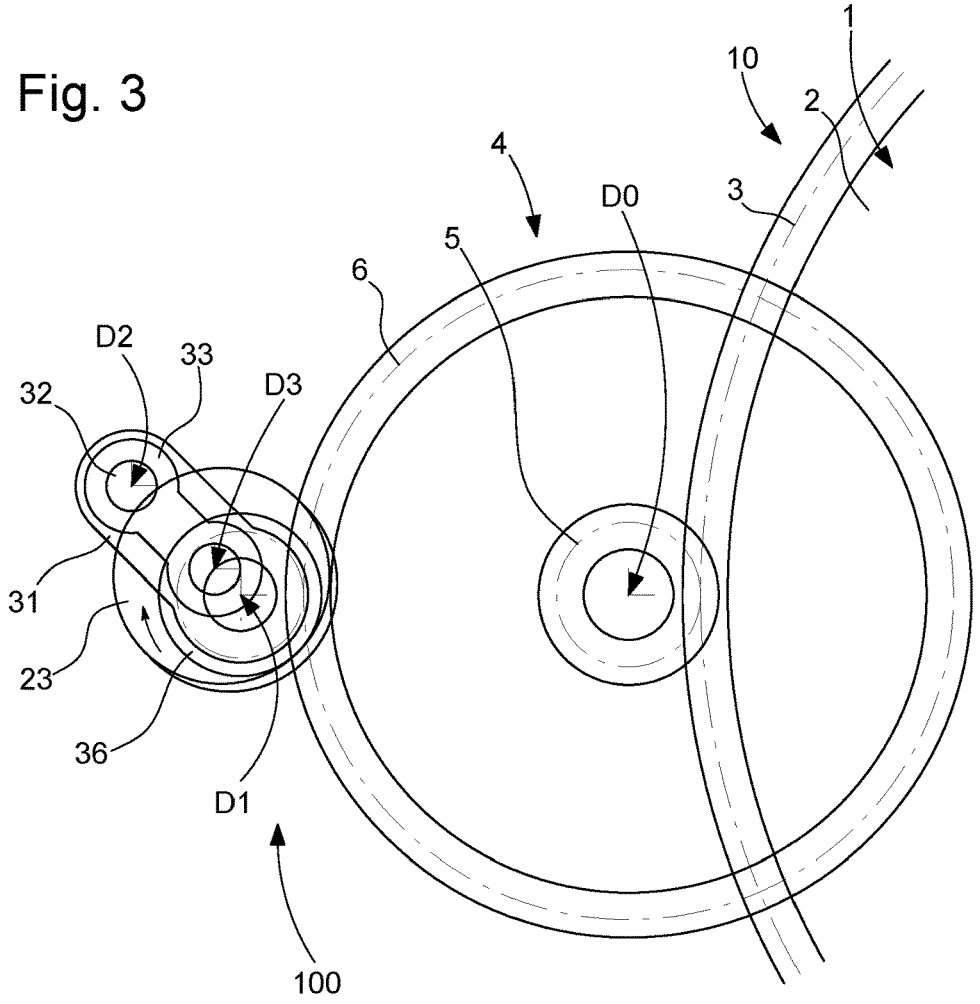
FIGS. 3 to 5 are three details that show, schematically in top view, the rotating regulator mechanism of FIG. 1, where the connecting-rod-crank-handle assembly is shown in three different states A, B, C, according to their relative angular positions.
Figure 4:
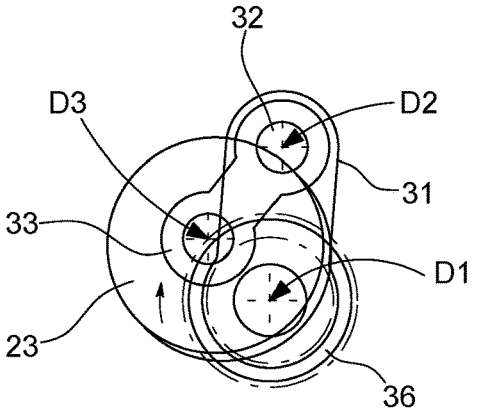
Figure 5:
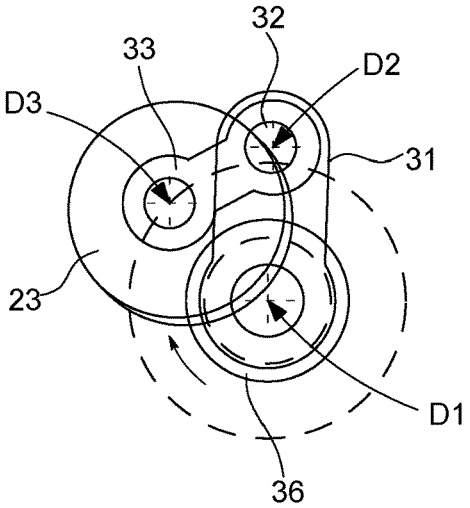

FIGS. 3 to 5 show various positions relating to the connecting-rod 33 and to the crank-handle 31:

A (FIG. 3): Minimum amplitude position: guarantee of no phase shift if #90°;

B (FIG. 4): Medium amplitude position;

C (FIG. 5): Large amplitude position.

It is noted as defect that the angle of the connecting-rod generates an angular offset, which depends on the amplitude, on the drive train. This defect, which may be detrimental for a time base having to guarantee the 10 ppm, remains completely admissible for a mechanism regulation, such as a striking mechanism regulation, or other.

The energy input here is ensured by a finishing train 4 and a barrel 2, in a manner known by the person skilled in the art.

The invention also relates to a timepiece 1000 including at least one main oscillator 900 constituting a time base, and that includes at least one such rotating regulator mechanism 100. According to the invention, each oscillator mechanism 20 is distinct from this main oscillator 900.

More particularly, such a rotating regulator mechanism 100 is arranged to regulate the rotational speed of a timepiece mechanism that is a striking mechanism.

More particularly, such a rotating regulator mechanism 100 is arranged to regulate the rotational speed of a timepiece mechanism that is a date drive mechanism.

The invention claimed is:

1. A timepiece rotating regulator mechanism for regulating rotational speed of a timepiece mechanism subjected to action of motor means through transmission means, said rotating regulator mechanism comprising:

an oscillator mechanism including an inertial mass and an elastic return means, the inertial mass being fastened by the elastic return means and arranged to oscillate about an oscillator axis in relation to a fixed structure to which a first end of the elastic return means is attached; and movement transformation means which indirectly connects the oscillator mechanism to the transmission means, the movement transformation means including a connecting-rod-crank-handle system which includes a crank-handle that is rotated about a crank-handle axis by said transmission means, and a connecting-rod which is angularly moveable in relation to said crank-handle, in a plane perpendicular to said crank-handle axis, at a first contact zone eccentric in relation to said crank-handle axis, wherein said connecting-rod is angularly moveable in relation to a said inertial mass in the plane perpendicular to said crank-handle axis at a second contact zone that is distant from said first contact zone, to ensure maintenance of said oscillator mechanism by energy supplied by said motor means, and to ensure speed regulation of a train of said transmission means in relation to a frequency of said oscillator mechanism, wherein a second end of the elastic return means is attached to the connecting rod, and wherein the oscillator axis is parallel to the crank-handle axis.

2. The rotating regulator mechanism according to claim 1, wherein said at least one connecting-rod is articulated by a first articulation with said crank-handle at said first contact zone, and by a second articulation, which is distant from said first articulation, with said inertial mass at said second contact zone.

3. The rotating regulator mechanism according to claim 2, wherein said connecting-rod-crank-handle system comprises a receiver wheel set integral with said crank-handle and rotated about said crank-handle axis by said transmission means, said crank-handle including, at said first articulation, a crank pin or a bore, defining a crank pin axis about which freely pivots, via a bore or respectively a trunnion that it includes, said connecting-rod that includes, at a distance from said crank pin axis, and at said second articulation, a guide cooperating in a complementary manner with an additional guide integral with said inertial mass.

4. The rotating regulator mechanism according to claim 1, wherein said at least one connecting-rod is integral with at least one connecting-rod flexible blade moveable in a plane perpendicular to said crank-handle axis, and angularly moveable, in said plane or in projection over said plane, in relation to at least one crank-handle flexible blade integral with said at least one crank-handle or constituting said crank-handle.

5. The rotating regulator mechanism according to claim 4, wherein said at least one connecting-rod flexible blade and said at least one crank-handle flexible blade are arranged on at least two parallel levels.

6. The rotating regulator mechanism according to claim 4, wherein at least one said connecting-rod and at least one said crank-handle together constitute a single one-piece component incorporating flexible blades.

7. The rotating regulator mechanism according to claim 1, wherein said at least one oscillator flexible blade is unique.

8. The rotating regulator mechanism according to claim 1, wherein said at least one oscillator flexible blade consists of a bending and/or twisting wire.

9. The rotating regulator mechanism according to claim 3, wherein, either said guide is a bore and said additional guide is a spherical surface of a ball joint integral with said inertial mass, or said guide is a toric surface and said additional guide is a cylindrical surface of a trunnion integral with said inertial mass.

10. The rotating regulator mechanism according to claim 1, wherein said inertial mass is arranged to oscillate linearly or according to a single degree of freedom along an imposed path, and is subjected on either side to the action of elastic return means fastened to a fixed structure that said rotating regulator mechanism includes.

11. A timepiece comprising at least one main oscillator constituting a time base, and including at least one rotating regulator mechanism according to claim 1, wherein each said oscillator mechanism is distinct from said main oscillator.

12. The timepiece according to claim 11, wherein said rotating regulator mechanism is arranged to regulate the rotational speed of a said timepiece mechanism that is a striking mechanism.

13. The timepiece according to claim 11, wherein said rotating regulator mechanism is arranged to regulate the rotational speed of a said timepiece mechanism that is a date drive mechanism.

14. A timepiece rotating regulator mechanism for regulating rotational speed of a timepiece mechanism subjected to action of motor means through transmission means, said rotating regulator mechanism comprising:

an oscillator mechanism including an inertial mass and an elastic return means; and movement transformation means which indirectly connects the oscillator mechanism to the transmission means, the movement transformation means including a connecting-rod-crank-handle system which includes a crank-handle that is rotated about a crank-handle axis by said transmission means, and a connecting-rod which is angularly moveable in relation to said crank-handle, in a plane perpendicular to said crank-handle axis, at a first contact zone eccentric in relation to said crank-handle axis, wherein said connecting-rod is angularly moveable in relation to said inertial mass in the plane perpendicular to said crank-handle axis at a second contact zone that is distant from said first contact zone, to ensure maintenance of said oscillator mechanism by energy supplied by said motor means, and to ensure speed regulation of a train of said transmission means in relation to a frequency of said oscillator mechanism, and wherein said at least one connecting-rod is integral with at least one connecting-rod flexible blade moveable in a plane perpendicular to said crank-handle axis, and angularly moveable, in said plane or in projection over said plane, in relation to at least one crank-handle flexible blade integral with said at least one crank-handle or constituting said crank-handle.

* * * * *